US005930865A

United States Patent [19]

Mihalcheon

[11] Patent Number: 5,930,865

[45] Date of Patent: Aug. 3, 1999

[54] EXTENSION SPRING-TYPE ASSEMBLY FOR RAISING SECTIONAL DOOR

[76] Inventor: Arthur Alexander Mihalcheon, 74 Valleyview Crescent, Edmonton, Alberta, Canada, T5R 5T1

[21] Appl. No.: 09/017,061

[22] Filed: Feb. 2, 1998

[51] Int. Cl.[6] ..... E05D 13/00

[52] U.S. Cl. ..... 16/197; 16/DIG. 1; 16/401; 160/191; 49/200

[58] Field of Search ..... 16/197, 198, 400, 16/401, DIG. 1, DIG. 7; 160/191, 192, 193, 201; 49/200, 199

[56] References Cited

U.S. PATENT DOCUMENTS 1,931,166 10/1933 McCloud ..... 160/191
2,041,221 5/1936 Brunst ..... 160/191

*Primary Examiner*—Chuck Y. Mah
*Attorney, Agent, or Firm*—E. Peter Johnson; Jennifer L. Bales

[57] ABSTRACT

The assembly comprises an extension spring anchored at one end to a winch mounted to the door opening frame. A double-grooved pulley is mounted on a plate secured to the free end of the spring. A fixed second double-grooved pulley is mounted to the door frame. A pair of cables are anchored at one end to the door frame and extend in parallel to pass around the two pulleys. After the second pulley, the cables separate and extend down to the bottom corners of the door, to which they are secured. Upon release of the door latch with the door down, the spring contracts and, through the first pulley, applies an equal pull to the two cables so that they move at the same rate, thereby raising the door smoothly.

5 Claims, 3 Drawing Sheets

EXTENSION SPRING-TYPE ASSEMBLY FOR RAISING SECTIONAL DOOR

FIELD OF THE INVENTION

This invention relates to a lifting assembly for an overhead sectional door. More particularly it relates to an extension spring-driven assembly for this purpose.

BACKGROUND OF THE INVENTION

In general, there are two types of lifting assembly (referred to as "hardware"), used to lift overhead sectional doors.

The first type is known as a torsion spring system. It involves a single steel shaft mounted to the header of the door opening. A pair of torsion springs are slipped over the ends of the shaft and abut a fixed central anchor bracket at their inner ends. The free end of each spring is then connected with a winding plug slipped onto the shaft. A winding rod is used to turn the plug and wind the spring. The plug is then secured to the shaft with set screws. A cable drum is mounted at each end of the shaft. A cable is secured to each drum and extends down to the base of the door, to which it is attached. The door is pulled down and locked in place. When the door is unlocked, the springs unwind, turn the shaft and roll the cables up on the drums, thereby lifting the door.

The beauty of the torsion spring system is that the two cables are wound up by a common shaft. The rate of winding for each cable is therefore the same. As a result, the door rises smoothly—it does not become canted and bind as it is raised.

A disadvantage of the torsion spring system is that the hardware is relatively expensive.

An extension spring system commonly involves mounting two extension springs, one on each side of the door. Each spring is anchored at its base to the lower end of the door opening frame. A movable pulley is attached to the upper end of the spring. A second fixed pulley is suspended from a head plate secured to the door opening frame. A cable is anchored at one end to the head plate. Its free end passes around the pulleys, extends down the length of the door and is attached at its lower end to the door. When the door latch is released with the door closed, the two springs contract and each spring pulley pulls up on its cable, which causes the door to be raised.

One problem with the extension spring system is that the springs may pull unevenly, causing the door to cant and bind. However, this system is less expensive than the torsion spring system and it is therefore commonly used for household garage doors.

Another problem with the extension spring system has to do with the usual technique used to attach the spring to the door frame. This technique involves first lifting the door to the "up" position and blocking it there. The spring is then attached to the door frame after which the door is unblocked and lowered to stretch the spring. Raising the dead weight of the door usually requires more than one person. Installers are therefore not favorably inclined to extension spring systems because of the need for more than one person to carry out installation.

An objective of the present invention is to provide an extension spring-type system which, like a torsion spring system, applies equal lifting force and raising rate to each side of the door, to thereby achieve a smooth lifting action free of canting and binding, while still maintaining the lower cost associated with an extension spring assembly.

Another objective is to facilitate installation of the system using only one person.

SUMMARY OF THE INVENTION

In accordance with the invention:

An extension spring means is anchored at one end to the door opening frame. Preferably it is mounted along the top header. Preferably it is anchored by attaching it to a winch which can be used to initially stretch the spring means;

First pulley means, capable of working with two cables simultaneously, is attached to the free end of the spring. By "working with two cables simultaneously" is meant that a single rotatable pulley. means is provided which can accommodate two cables passing thereover, so that the cables will advance longitudinally at the same rate. Preferably the pulley means comprises a double groove pulley;

Two cables are anchored at one end to the door opening frame. The cables pass in parallel around the spring's double groove pulley. The free ends of the two cables then pass around a stationary second pulley means capable of working with two cables simultaneously. This second pulley means is secured to the door opening frame, preferably in line with and spaced from the first pulley means;

The cables then separate and extend to the two corners at the base of the door, to which they are attached. Preferably, one extends directly and vertically from the second pulley means; the other extends over a stationary third pulley, attached to the door frame header, and then extends down to the base of the door.

From the foregoing it will be noted that the single extension spring means pulls on both cables with the same force and moves them at the same rate using the first and second pulley means, thereby minimizing the risk of canting and binding, so that the door is raised smoothly.

Broadly stated, the invention is, in combination: a door frame forming an opening; an overhead sectional door, having top and bottom corners, mounted in the opening; and an overhead door lifting assembly comprising: extension spring means having first and second ends; the first end of the spring means being anchored to the door frame; a single rotatable first pulley means, operative to advance two cables simultaneously thereover at the same rate, attached to the second end of the spring means and being free to move therewith; a single rotatable second pulley means, operative to advance two cables simultaneously thereover at the same rate, anchored to the door frame in spaced relation with the first pulley means; a pair of cables, each having first and second ends, said cable first ends being anchored to the door frame, said cables passing in parallel over the first and second pulley means, said cable second ends extending separately from the second pulley means to the lower corners of the door and being attached thereto; so that contraction of the spring means causes the first pulley means to pull on the cables with equal force and so that the cables move at the same rate over the first and second pulley means to raise the door evenly.

DESCRIPTION OF THE PREFERRED EMBODIMENT

Figure 1:
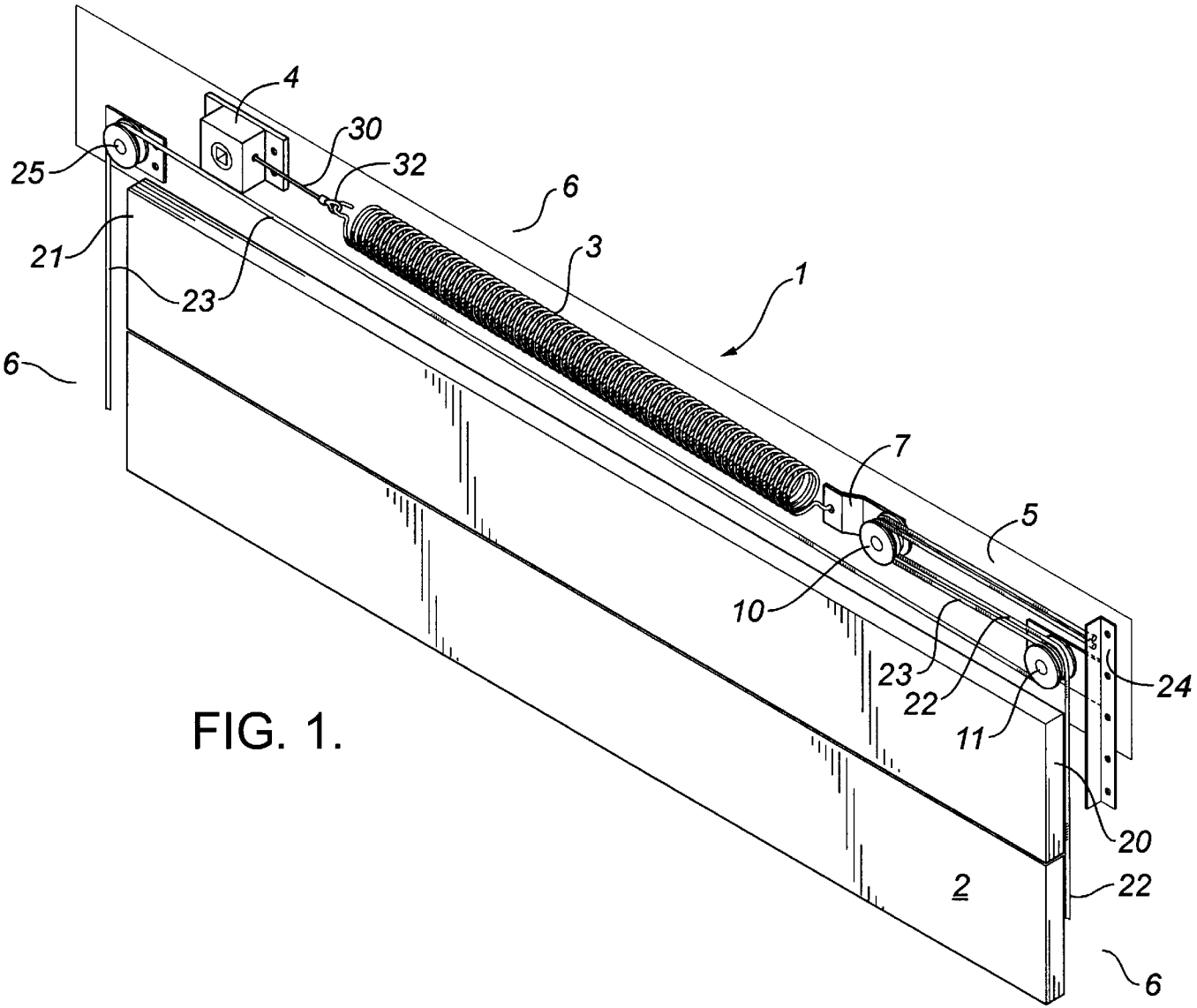
FIG. 1 is a perspective view showing the upper end of a sectional door equipped with hardware in accordance with the invention.
Figure 2:
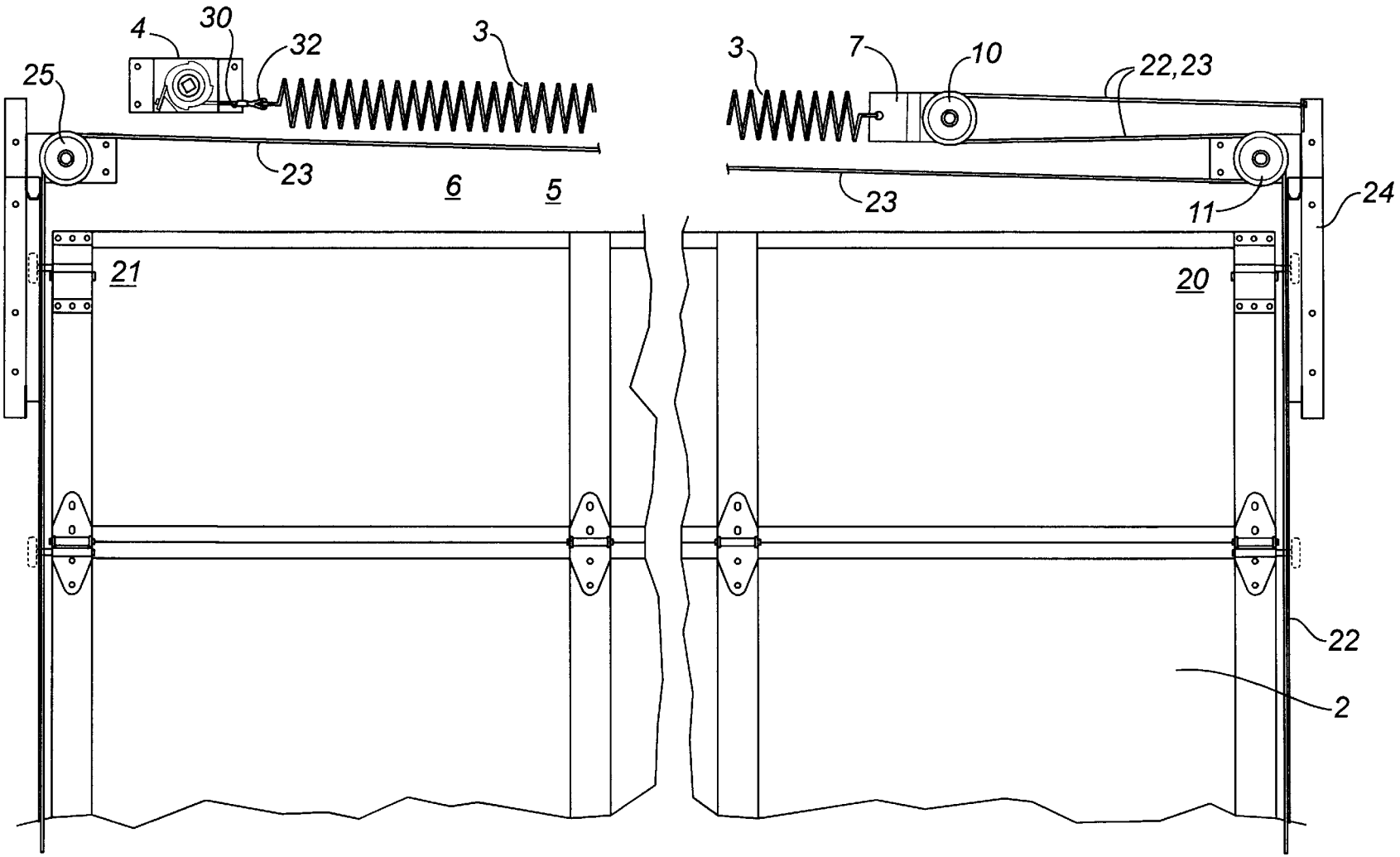
FIG. 2 is an expanded front view of the left and right portions of the door and hardware of FIG. 1.
Figure 3:
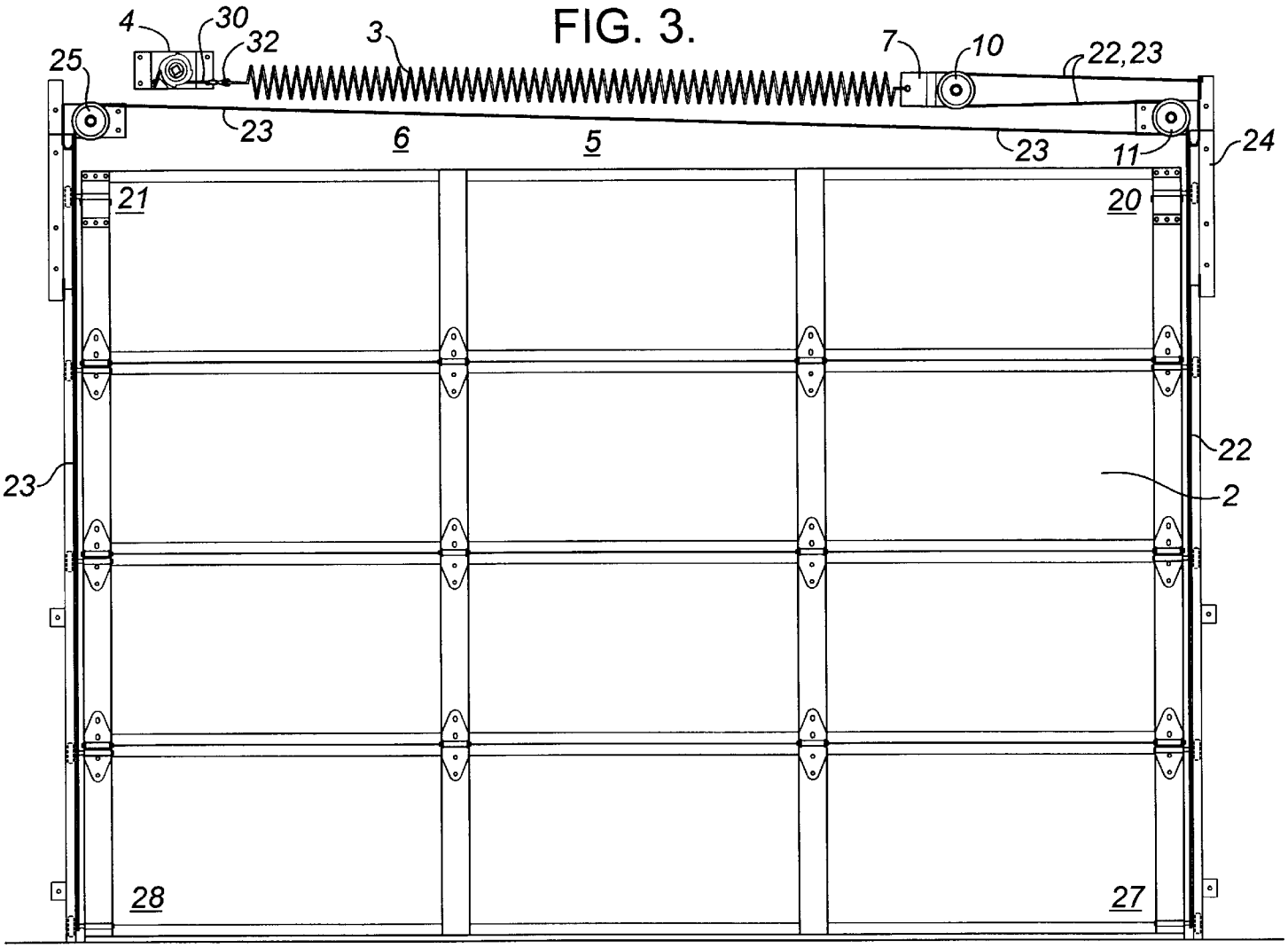
FIG. 3 is a front view of the door and hardware of FIG. 1.

Having reference to the Figures, the invention comprises a lifting assembly 1 for raising a sectional door 2.

The lifting assembly 1 comprises an extension spring 3 secured at one end to a stationary winch 4 or plate 4*a* attached to the header 5, forming part of the door frame 6.

At its other end the spring 3 is connected with a moving plate 7.

A first double-grooved pulley 10 is rotatably mounted to the plate 7.

A second double-grooved pulley 11 is rotatably mounted to the header 5 at one upper corner 20 of the door 2.

A third single-grooved pulley 25 is mounted to the header 5 at the other upper corner 21 of the door 2.

Two cables 22, 23 are attached at one end to a bracket 24 secured to the header 5 adjacent the door corner 20. The cables 22, 23 pass around the first and second pulleys 10, 11 as shown. One cable 22 then extends down directly to the door lower corner 27. The other cable 23 extends over the third pulley 25 and down to the door lower corner 28. The cables 22, 23 are secured to the door 2 at the corners 27, 28 respectively.

When the door latch (not shown) is released, the spring 3 contracts, pulling on the first pulley 10 and thereby pulling with equal force on the cables 22, 23 with the result that the cables are moved at the same rate to raise the door 2. The door 2 is therefore raised smoothly, without significant canting or binding.

The best mode of the invention is shown with double-grooved pulleys 10, 11 in use. However those skilled in the art will appreciate that a single smooth-surfaced pulley can be substituted as an alternative.

The scope of the invention is defined in the claims now following.

The embodiments of the invention in which an exclusive property or privilege is claimed are defined as follows:

1. In combination:

a door frame forming an opening;

an overhead sectional door, having top and bottom corners, mounted in the opening; and an overhead door lifting assembly comprising:

extension spring means having first and second ends;

the first end of the spring means being anchored to the door frame;

a single rotatable first pulley means, operative to advance two cables simultaneously thereover at the same rate, attached to the second end of the spring means and being free to move therewith;

a single rotatable second pulley means, operative to advance two cables simultaneously thereover at the same rate, anchored to the door frame in spaced relation with the first pulley means;

a pair of cables, each having first and second ends, said cable first ends being anchored to the door frame, said cables passing in parallel over the first and second pulley means, said cable second ends extending separately from the second pulley means to the lower corners of the door and being attached thereto;

so that contraction of the spring means causes the first pulley means to pull on the cables with equal force and so that the cables move at the same rate over the first and second pulley means to raise the door evenly.

2. The assembly as set forth in claim 2 wherein:

the door frame has a header having first and second ends;

the spring means extends along the header;

the second pulley means is anchored to the header over one upper corner of the door so that one cable extends directly down to one lower corner of the door, to which it is attached;

said assembly further comprising:

a rotatable third pulley secured to the header over the other upper corner of the door; and said other cable passes over the third pulley and extends down to the other lower corner of the door, to which it is attached.

3. The assembly as set forth in claim 2 wherein:

the first and second pulley means each comprise a single double-grooved pulley.

4. The assembly as set forth in claim 1 wherein:

the first and second pulley means each comprise a single double-grooved pulley.

5. The assembly as set forth in claims 1, 2, 4, or 3 comprising:

which means, connected with the door frame and the first end of the spring means, for anchoring and stretching the spring means.

* * * * *